US006205674B1

(12) United States Patent
Kaizuka

(10) Patent No.: US 6,205,674 B1
(45) Date of Patent: Mar. 27, 2001

(54) HAIR DRYER

(75) Inventor: Kazutoshi Kaizuka, Fukuoka (JP)

(73) Assignee: Create Co., Ltd., Fukuoka (JP)

( * ) Notice: Subject to any disclaimer, the term of this patent is extended or adjusted under 35 U.S.C. 154(b) by 0 days.

(21) Appl. No.: 09/399,044

(22) Filed: Sep. 21, 1999

(51) Int. Cl.[7] ..... A45D 20/00

(52) U.S. Cl. ..... 34/96; 34/97; 392/385; 219/553

(58) Field of Search ..... 34/96, 97; 392/383, 392/384, 385, 379, 392; 219/553

(56) References Cited

FOREIGN PATENT DOCUMENTS

2211419 * 5/1989 (GB) .

* cited by examiner

*Primary Examiner*—Pamela Wilson
(74) *Attorney, Agent, or Firm*—David B. Abel; Squire, Sanders & Dempsey L.L.P.

(57) ABSTRACT

A hair dryer used for drying and styling hair includes a heating element in a passage connecting an air inlet and an air outlet. The heating element has a ceramic coating layer, which is coated with mixed powder of extreme infrared material and poly-element minerals, both in powder form.

6 Claims, 1 Drawing Sheet

HAIR DRYER

BACKGROUND OF THE INVENTION

1. The Field of the Invention

The field of the invention relates to hair dryers used for drying and styling hair.

2. Background Information

A hair dryer is used to dry and style the hair by blowing warm or cool air. Blow dry styling, with the use of a conventional hair dryer, however, is difficult when styling fine hair. A significant amount of time is required for styling because of the ineffectiveness of a conventional hair dryer that simply blows out warm or cool air. Further, the conventional hair dryer's function of blowing out warm or cool air was unsatisfactory in the fixation of hair dye or acid hair dye, and did nothing for dull hair. Because of the operation of the conventional hair dryer, problems also occurred during the application of a permanent using curling rods, creating hair which lacked a shiny and supple appearance. Additionally, blow dry styling with a conventional hair dryer was often unable to prevent the loss of hair waves.

Thus, a need was perceived for a hair dryer that enables effective and fast blow drying and styling, along with a long lasting hold after hair styling, as well as shiny, supple hair, and long lasting curls after the application of a permanent with the use of curling rods.

SUMMARY OF THE INVENTION

In order to overcome the above mentioned problems, the present hair dryer invention is comprised of a heating element installed within an airflow passage which runs from an air inlet to an air outlet. The heating element is coated with a ceramic layer that is made from a combination of extreme infrared radiation material powder and poly-element minerals powder.

Also, the hair dryer is configured with a nozzle that can be easily attached to or removed from the outlet of the hair dryer. The nozzle is coated with a ceramic layer of mixed powder comprised of extreme infrared radiation material and poly-element minerals, both in powder form.

The configuration of the hair dryer allows for emission of extreme infrared radiation from the extreme infrared radiation material powder by heating the heating element. Accordingly, the hair and scalp absorb the radiation and, in turn, the absorbed radiation heats the hair and scalp from the inside. The use of the dryer enables one to dry or style the hair by blowing less hot air onto the hair, and doing so in a shorter amount of time than required with conventional dryers. Therefore, the hair and the scalp are not damaged, and blood circulation in the capillary vessels of the scalp is promoted. Accordingly, hair will keep healthy and shiny. Additionally, the capacity of the heating element for the invention can be made smaller, which means it is possible to produce a more compact and more energy efficient dryer by using this invention.

Furthermore, electromagnetic waves (feeble energy) with wavelengths of 4 to 14 $\mu$m, which are emitted from the poly-element minerals powder, transform the surrounding of an atomic nucleus such that the atom and the material reach an excited state. This transformation accordingly causes a cutting and shortening of the polymerization of water clusters, decreasing the volume of water and increasing the specific gravity. Furthermore, sufficient attachment of free water onto the external cell membranes of animals and plants occurs. As a result, penetration of water, as well as that of $Ca^{2+}$, is promoted within the cells, which activate several functions of the cells. When these electromagnetic waves are applied to the hair and scalp by blowing warm or cold air, water within the hair and scalp will be mineralized, and protein in the hair and scalp will be activated, keeping the hair healthy and shiny.

Accordingly, it is an object of the present invention to provide a hair dryer that allows for quick drying and styling of hair by harnessing the effect of electromagnetic waves. Other and further objects and advantages will appear hereinafter.

BRIEF DESCRIPTION OF DRAWINGS

It is to be understood that the accompanying drawing is provided for the purpose of illustration only, and is not intended as a definition of the limits of the invention.

DETAILED DESCRIPTION OF THE PREFERRED EMBODIMENT

Figure 1:
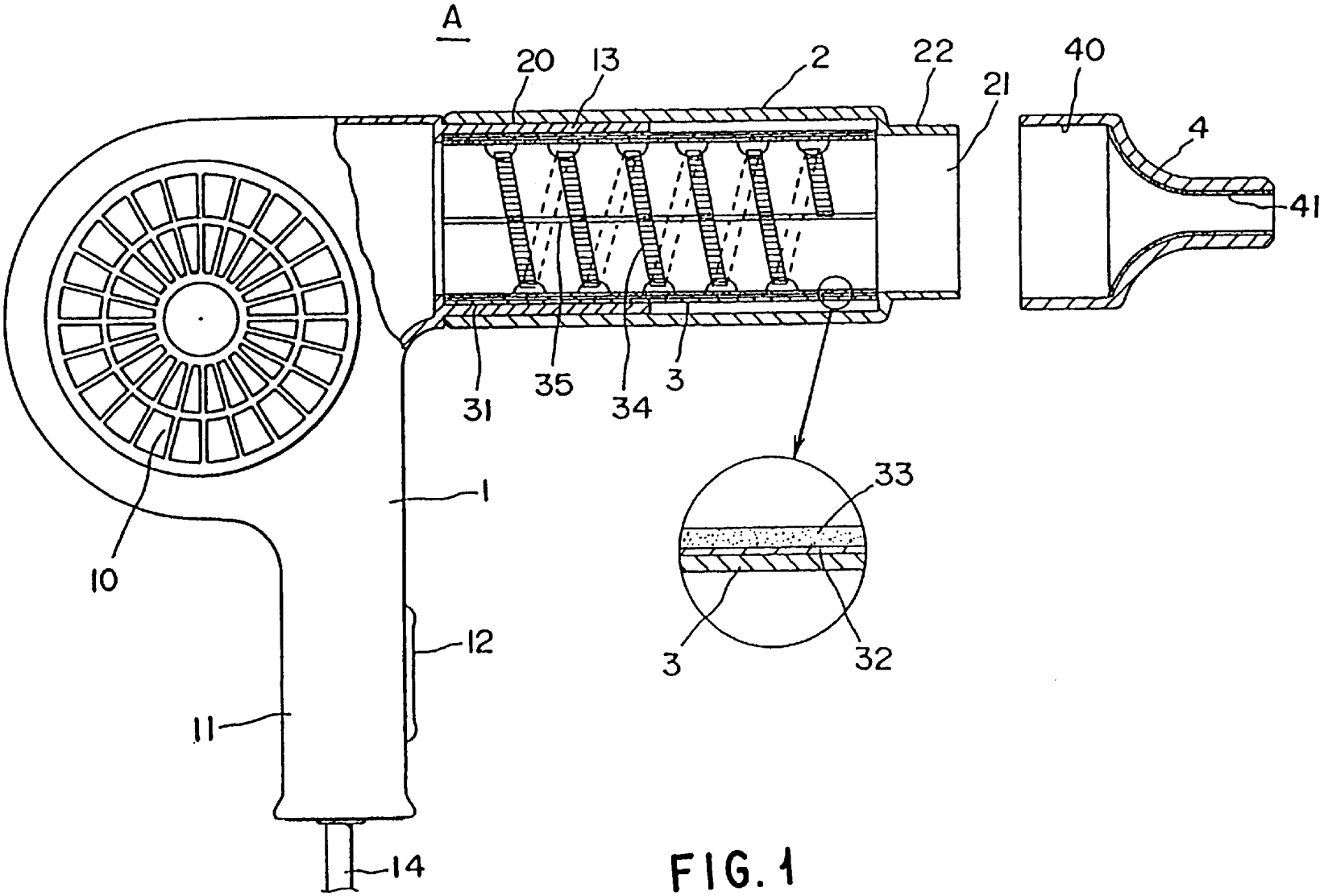
FIG. 1 is a sectional view of the preferred embodiment of a hair dryer of the present invention.

Referring to FIG. 1, a hair dryer A comprises a main body 1, a cylindrical outlet part 2, a heating element 3, and a nozzle 4. The hair dryer A is made of heat-resistant plastic material.

An impeller (not shown) is installed inside the main body 1. Air inlets 10 are found on both sides of the impeller. The body 1 has a handle 11. The handle 11 has a switch 12 for selecting warm or cold air and for adjusting the volume and temperature of the air. A cylindrical connecting part 13 connects the cylindrical outlet part 2 with the main body 1 by fitting the outlet part 2 onto the outer circumference of the connecting part 13. An electrical cord is indicated by 14.

The cylindrical outlet part 2 is connected to the body 1 by fitting a base edge part 20 onto the outer circumference of the connecting part 13. An outlet 21 is found at a cylindrical part 22 with a diameter smaller than that of the cylindrical outlet part 2. The cylindrical part 22 with the smaller diameter is designed to fit into a base edge fitting part 40 of the nozzle 4.

The heating element 3 heats air provided by the impeller. The heating element 3 is formed in a cylindrical shape and installed within the cylindrical outlet part 2. The heating element 3 is fixed in place by fitting a base edge part 31 onto the internal circumference of the connecting part 13. The heating element 3 is made of metal, preferably aluminum, and is covered with a cylindrical-shaped mica product 32 which functions as an electrical and heat insulator. The cylindrical-shaped mica product 32 is, in turn, covered with a ceramic coating 33 made of a mixed powder. Heat-resistant Formica, a coating agent, is added to the mixed powder, which is a mixture of extreme infrared powder and poly-elements mineral powder, and then applied on the cylindrical-shaped mica product 32. The liquid content of the coating agent is vaporized by heat treatment in a heating oven.

Extreme infrared radiation materials include powders of: alumina ($Al_2O_3$), titania ($TiO_2$), ferrite ($Fe_2O_3$), chromium oxide ($Cr_2O_3$), silica ($SiO_2$), yttria ($Y_2O_3$), and magnesia (MgO). These powders are blended so that they give off extreme infrared radiation at wavelengths that are easily absorbed into the hair and scalp.

Poly-element minerals include silicon-based minerals with various elements such as perlite, pitchstone, tourmaline. These minerals radiate electromagnetic waves (feeble energy). When the electromagnetic waves are blown onto the hair in hot or cold air, water within the hair will be mineralized, and protein in the hair will be activated. Poly-element minerals, such as perlite, are milled into a powder the size of about 1 to 3 microns, using a ball mill. Preferably, the poly-element minerals powder is made and used by blending two or more such minerals with the proper blending ratio. The powder can be used as it is. Alternatively, it can also be used after it is mixed with water, and heated or pressurized, so that the clear liquid part of the water dries into a powder by vacuum-freeze drying or by spray drying methods.

The following chart shows the content of perlite:

| | |
|---|---|
| Anhydrous Silicon ($SiO_2$) | 71.94% |
| Aluminum Oxide ($Al_2O_3$) | 14.94% |
| Iron Oxide ($Fe_2O_3$) | 2.54% |
| Magnesium Oxide (MgO) | 0.44% |
| Calcium Oxide (CaO) | 2.47% |
| Alkali Oxide ($K_2O + Na_2O$) | 6.87% |
| Manganese Oxide (MnO) | 0.03% |
| Anhydrous Phosphoric Acid ($P_2O_5$) | 0.14% |
| Reduction in mass when heated | 3.43% |
| Reduction in mass when dried (at 110° C.) | 0.07% |
| Others, Titanium | trace |

A cross-shaped mica plate 35, around which a Nichrome wire 34 is wound, is inserted into the heating element 3. Controlling the switch 12 can start and stop the passage of the current through the Nichrome wire 34.

The nozzle 4 is attached to the body by fitting the base edge fitting part 40 onto the outer circumference of the cylindrical part 22 with the smaller diameter. The entire inside of the nozzle 4, except for the fitting part 40, has the ceramic coating layer made up of the same components as that of the cylindrical mica product 32.

Accordingly, the configuration mentioned above allows for the following processes: Turning switch 12 on energizes the Nichrome wire 34 and starts the impeller. Then, through the outlet 21 and the nozzle 4, the dryer A can blow out warm air that is heated by the Nichrome wire 34. If cold air is desired, the air is blown with the impeller, yet without energizing the Nichrome wire 34.

The dryer A of this embodiment constantly generates electromagnetic waves from the ceramic coating layers 33 and 41. When these electromagnetic waves (feeble energy) are blown onto hair in warm or cold air, water in the hair is mineralized and hair protein is vitalized, which makes the hair healthy and shiny. Since the extreme infrared radiation heats the hair and skin from the inside, the dryer enables one to dry and style the hair at a lower air temperature and in a shorter amount of time compared to using conventional dryers. The electromagnetic waves (feeble energy) and the extreme infrared radiation are reflected on the heating element (aluminum film) 3 installed inside the airflow passage; and those reflections travel through the outlet 21 and the nozzle 4 to the outside.

Thus, a hair dryer has been disclosed. While variations of the illustrated preferred embodiment have been shown and described, it would be apparent to those skilled in the art that many more modifications are possible without departing from the inventive concepts herein. For example, another embodiment can be produced in one piece instead of by connecting the main body to the cylindrical outlet body, as disclosed in the preferred embodiment. Another embodiment can be a hooded dryer, while the present embodiment is a handheld one. The invention, therefore, is not to be restricted except in the spirit of the appended claims.

What is claimed is:

1. A hair dryer comprising:

a main body including an air inlet;

a handle portion and a cylinder defining an air passage wherein the air passage is connected at first end to said air inlet of said main body, and extends to a second air outlet end;

a ceramic layer of mixed powder including both extreme infrared radiation material powder and poly-element minerals powder coating an interior wall of at least a portion of said cylinder defining said air passage said poly-element minerals powder being processed so as to emit feeble energy electromagnetic waves into an air-flow flowing through said cylinder without heat activation; and an impeller activated by said switch to force air inducted from said air inlet through said air passage to exhaust from said air outlet end of said cylinder.

2. The hair dryer of claim 1, further comprising a nozzle said nozzle configured to allow attachment to said air outlet end of said cylinder, an inside portion of said nozzle being coated with a ceramic layer of mixed powder comprised of extreme infrared radiation material and poly-element minerals.

3. The hair dryer according to claim 1, wherein said extreme infrared powder is a blended mixture of powders including alumina ($Al_2O_3$), titania ($TiO_2$), ferrite ($Fe_2O_3$), chromium oxide ($Cr_2O_3$), silica ($SiO_2$), yttria ($Y_2O_3$), and magnesia (MgO).

4. The hair dryer according to claim 1, wherein said poly-element minerals powder is perlite.

5. The hair dryer according to claim 4, wherein said heating element is coated with a ceramic layer of mixed powder including both extreme infrared radiation material powder and poly-element minerals powder coating the surface of at least a portion of said heating element.

6. The hair dryer according to claim 1, further comprising at least one heating element within said cylinder wherein said heating element is made of a metal.

* * * * *